US008479949B2

(12) United States Patent
Henkel

(10) Patent No.: US 8,479,949 B2
(45) Date of Patent: Jul. 9, 2013

(54) LID ASSEMBLY FOR A LIQUID CONTAINER

(75) Inventor: Christoph Henkel, Siegen (DE)

(73) Assignee: P. Henkel GmbH, Kreuztal (DE)

( * ) Notice: Subject to any disclaimer, the term of this patent is extended or adjusted under 35 U.S.C. 154(b) by 781 days.

(21) Appl. No.: 12/283,065

(22) Filed: Sep. 9, 2008

(65) Prior Publication Data

US 2009/0134164 A1 May 28, 2009

(30) Foreign Application Priority Data

Sep. 14, 2007 (DE) ..... 20 2007 012 923 U

(51) Int. Cl.
*B65D 43/14* (2006.01)

(52) U.S. Cl.
USPC ..... 220/835; 220/908; 220/324; 220/326

(58) Field of Classification Search
USPC ..... 220/326, 324, 835, 908, 833, 834, 220/784, 254.3, 252
See application file for complete search history.

(56) References Cited

U.S. PATENT DOCUMENTS

| | | | | | |
|---|---|---|---|---|---|
| 3,688,942 | A * | 9/1972 | Mitchell et al. | ..... | 220/784 |
| 3,759,415 | A * | 9/1973 | Cloyd | ..... | 220/784 |
| 3,999,677 | A * | 12/1976 | Oberkircher | ..... | 220/266 |
| 4,691,840 | A * | 9/1987 | Ferbrache | ..... | 220/318 |
| 4,708,259 | A * | 11/1987 | Olimpio | ..... | 220/790 |
| 5,103,994 | A * | 4/1992 | Doxey et al. | ..... | 220/324 |
| 5,207,345 | A * | 5/1993 | Stewart et al. | ..... | 220/304 |
| 5,230,525 | A * | 7/1993 | Delmerico et al. | ..... | 280/47.131 |
| 5,323,923 | A * | 6/1994 | Schauer | ..... | 220/831 |
| 5,385,259 | A * | 1/1995 | Bernstein et al. | ..... | 220/495.11 |
| 5,520,303 | A * | 5/1996 | Bernstein et al. | ..... | 220/495.08 |
| 5,641,090 | A * | 6/1997 | Kowalski et al. | ..... | 220/782 |
| 5,699,929 | A * | 12/1997 | Ouno | ..... | 220/323 |
| 6,191,691 | B1 * | 2/2001 | Serrault | ..... | 340/572.8 |
| 2003/0155366 | A1 * | 8/2003 | Raghunathan | ..... | 220/835 |
| 2003/0160057 | A1 * | 8/2003 | Johansen | ..... | 220/835 |

* cited by examiner

*Primary Examiner* — J. Gregory Pickett
*Assistant Examiner* — Blaine Neway
(74) *Attorney, Agent, or Firm* — Harness, Dickey & Pierce, P.L.C.

(57) ABSTRACT

The invention relates to a lid assembly for a container, in particular for liquids, comprising a lid comprising at least one fastening clamp for fastening the lid assembly to the container, wherein the at least one fastening clamp is embodied in one piece on the lid.

21 Claims, 9 Drawing Sheets

LID ASSEMBLY FOR A LIQUID CONTAINER

FIELD OF THE INVENTION

The invention relates to a lid assembly for a container, in particular for liquids, comprising at least one fastening clamp for fastening the lid assembly to the container.

BACKGROUND OF THE INVENTION

It is known from the state of the art, for example for tool boxes or arranging cans, for provision to be made on lid assemblies for fastening clamps, which are held by means of a bolt. Usually provision is made on the lid assembly for fasteners for the purpose of accommodating the bolts. The fastening clamps can thus be rotated about the axis of the bolt. As a replacement for a bolt, it is also known for provision to be made on fastening clamps for lateral projections, which engage with the corresponding accommodations on the lid assembly. The fastening clamps can then be rotated about the lateral projections. The disadvantage of the known state of the art is that it is necessary to rotate each individual fastening clamp about the bolt and to bring the projections into engagement, respectively, for the purpose of fastening or removing the lid assembly to and from a container, respectively. In particular with cans comprising the described fastening clamps it is also disadvantageous that they are arranged so as to be distributed across the entire periphery at steady intervals so that a considerable amount of work is necessary until all of the fastening clamps are closed.

SUMMARY OF THE INVENTION

Based on the state of the art it is an object of the invention to provide a lid assembly, which is leak proof for liquids and which is capable of being opened and closed in a short period of time in a simple manner.

The object is solved by means of a lid assembly comprising the characterizing features of claims 1 and 14.

The instant lid assembly is advantageous in particular when using on cans, which can be used for disposing of waste liquids, such as fats or oils, among others. It is advantageous thereby that the lid assembly encompasses at least one, preferably two fastening clamps, which is/are embodied in one piece on the lid assembly. The one-piece construction makes it possible for the user of the lid assembly according to the invention to close the lid without additional measures by simply pushing it downwards. The fastening clamps, which are embodied on the lid in one piece, can also be removed again by means of one hand movement. In a preferred embodiment, the lid assembly is made of plastic, for example in an injection molding process, so that the fastening clamps embodied thereon can also be molded thereon.

It is furthermore advantageous that the lid assembly of the invention can be attached to existing, standardized containers, such as trash cans. Trash cans are produced according to standard EN 840 so that the lid assembly of the invention can be used for all of such cans. It is advantageous thereby that the lid configuration comprises a lid on which the fastening clamps are arranged. Preferably, two laterally arranged fastening clamps extend downwards from the lid across an upper peripheral edge of the container (in negative Z-direction in FIG. 1), so as to reach behind a flange or the like, which projects downwards at the upper peripheral edge of the can or which possibly also projects to the side (in X-direction in FIG. 1) in the case of a non-standardized can. The fastening clamps must be bent outwards in an elastic manner and catch with their hook-shaped ends behind the flange in a closing position when the lid is in a closed position. To close the lid, it is thus only necessary to push the lid downwards until the fastening clamps engage. For the purpose of opening the lid, the fastening clamps are pushed outwards by hand power and are moved upwards at the same time so that the engaging connection of the fastening clamps on the peripheral edge of the can is disengaged. Due to the elasticity of the fastening clamps, the closing position can be repeated arbitrarily.

It is furthermore advantageous that the lid assembly encompasses arms, which are embodied thereon in one piece and which extend outwards and which extend to a holding device arranged on the container. The holding device serves as a type of hinge, about the transverse axis of which the lid of the lid assembly can be rotated and thus opened.

It is also advantageous that provision is made on the lid assembly for at least one fastening arm, which extends across a predetermined length across the surface of the lid and which is, at the same time, supported on the holding device of the container and is guided thereon, respectively. The fastening arm can be embodied in one piece with the lid assembly or can be attached afterwards as an additional part. The at least one fastening arm ensures an additional protection against an unintentional opening of the lid, in particular in response to load peaks caused by liquids swashing against the lid.

In a special embodiment, the lid assembly of the invention can additionally encompass a skirt, which projects into the container. In a special embodiment, the skirt can encompass a correct fit to the inner wall of the container. The skirt projecting into the container thus has the particular purpose that a liquid vehemently bumping against the lid assembly (for example when the container falls over), does not completely impact the seal of the lid, but that it is largely absorbed by the skirt, which extends in peripheral direction along the inner wall of the container. In an alternative embodiment, the skirt can be arranged so as to be slightly spaced apart from the inner wall of the container. It is then sensible to provide an additional seal between the inner wall of the container and the skirt. It is also possible for the part of the skirt facing forward with respect to the container to be shorter so as to ensure an easier opening and closing of the lid. In the alternative or additionally, this front skirt part can also be capable of being moved elastically so that it can always abut against the inner wall of the container. For this purpose, provision could furthermore be made to slit the corners of the skirt in the front region. By means of the skirt, the lid assembly has additional protection against an unintentional opening of the lid and thus against the unintentional escape of liquids, because the skirt generates a frictional resistance on the inner wall. The impermeability is advantageous in particular when transporting hazardous material, such as waste oil.

The lid assembly is furthermore sealed against an unintentional liquid escape by means of its outer edge. For this purpose, the lid assembly encompasses a groove, which is directed downwards and which is complementary to an edge which extends upwards from the container. To ensure the impermeability, a seal, preferably a rubber seal, is arranged within this groove. In a special embodiment, the groove can be embodied so as to have different depths across its length so that the seal arranged therein runs at different depths at different locations in the groove. In so doing, the edge of the container projecting into the groove, which has a constant height, exerts a different compressive force at different locations of the seal, which leads to a particular impermeability across the entire periphery of the lid assembly. In a preferred embodiment, the groove can be evenly embossed at all four sides of the lid assembly. Preferably, the embossment can have a size of from 2 to 5 mm on each longitudinal size. In an advantageous embodiment, the skirt can be an extension of the inner web of the groove.

To stabilize and reinforce the lid, it is particularly advantageous for provision to be made on the lid for reinforcement beams, which can be embodied in one piece on the lid. The reinforcement beams can be embodied in any pattern, for example in a star-shaped manner or crosswise.

The use of the lid assembly is particularly advantageous for conventional, standardized trash cans so that additional costs for the development of new cans and assemblies are not necessary.

BRIEF DESCRIPTION OF THE DRAWINGS

Further advantages of the invention will be illustrated in detail below together with the description of a preferred exemplary embodiment of the invention by means of the figures. The illustration in the enclosed figures takes place in an exemplary manner and diagrammatically. In the figures, the same parts are provided with the same reference numerals. Only the elements which are important for comprehending the invention are illustrated.

DETAILED DESCRIPTIONS OF THE EMBODIMENTS

Figure 1:
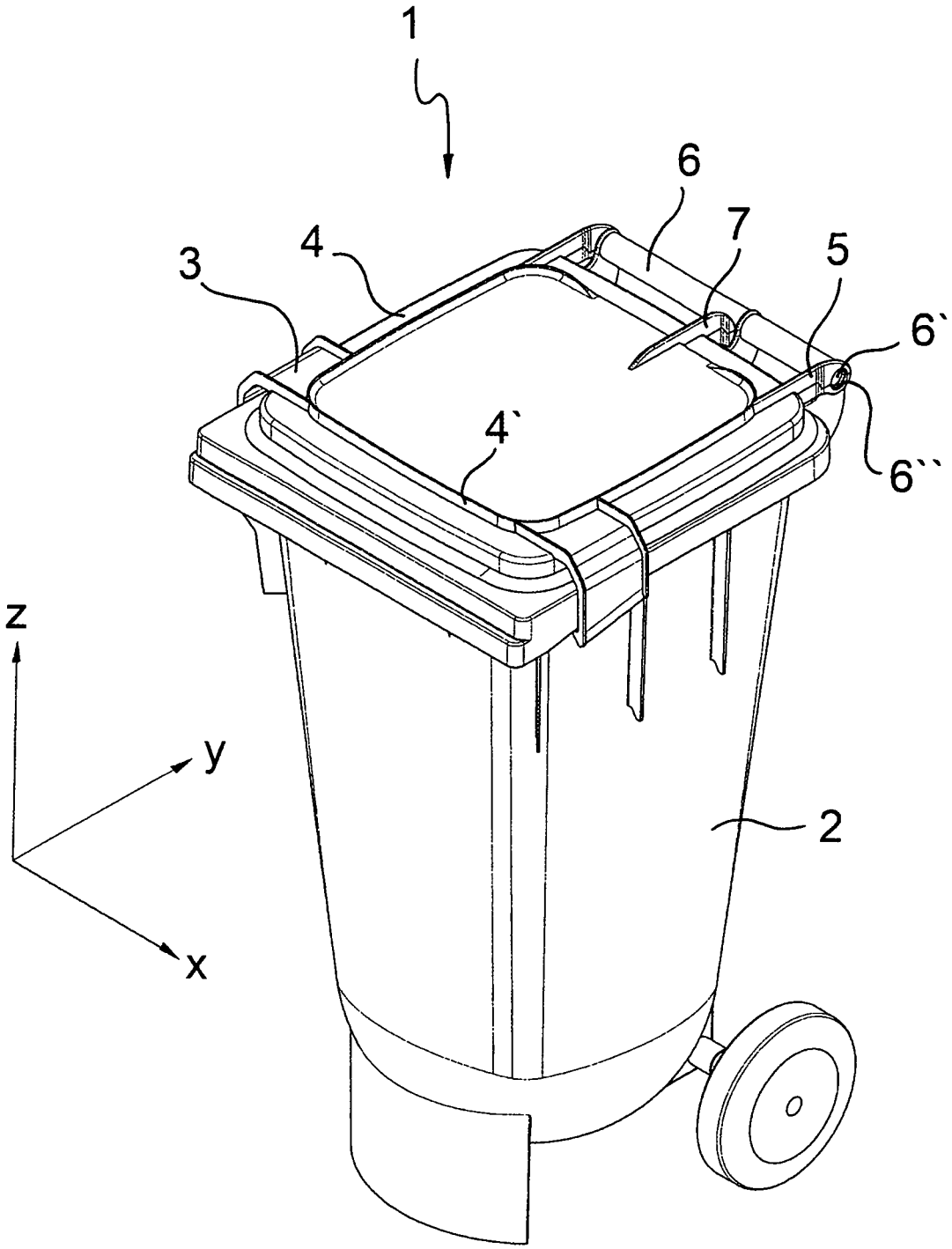
FIG. 1 shows the lid assembly of the invention on a container in a perspective view.

FIG. 1 illustrates the lid assembly 1 of the invention on a container 2, which is embodied in the manner of a trash can, in a perspective view at an incline from the top. The lid assembly 1, which is preferably made of plastic, can be attached to the container 2 and can be fastened thereto by means of two fastening clamps 3, which are embodied on the lid assembly 1 in one piece. Hinge arms 5 extend outwards from a lid 4 of the lid assembly 1 in the direction (Y-direction) of a holding device 6 provided on the container 2 and they are connected thereto. The connection of the hinge arms 5 with the holding device 6 is provided by hinge bolts 6", which are pressed from the side into holes 6' of the holding device 6 through openings 5' of the hinge arms 5. As is known from commercial trash cans, the lid 4 is to be opened by means of a rotary motion about the holding device 6.

The fastening clamps 3, which are embodied in one piece on the lid 4 of the lid assembly 1, initially extend outwards from the lid 4 in X-direction, form the shape of an arc about the edge of the lid assembly 1 and further extend downwards substantially at right angles in Z-direction so as to overlap the lid assembly 1 as well as the upper edge of the container 2 across their length. At their free end 3', the fastening clamps 3 preferably have the shape of a hook (see FIG. 2), by means of which they reach behind an edge, a flange or the like of the container 2. Furthermore, the lower flange of the fastening clamps 3 is slanted in Y-direction in the illustrated exemplary embodiment. Other embodiments can provide for a straight flange. Preferably, the fastening clamps 3 are made of plastic and are elastic so that they can bend outwards when the lid 4 is closed when they glide across the outer edge of the container 2 and so that they can subsequently reach behind the edge and the flange, respectively, or the like of the container 2 solely by means of their elastic reset force as soon as the closing position of the lid 4 has been reached. For the purpose of opening the fastening clamps 3, the lid is initially pressed downwards and the hook-shaped ends 3' are then bent outwards by hand power and the lid 4 is moved upwards at the same time. The pressing down is made possible by means of a flexible soft seal between lid and can, which will be defined in detail below. For the purpose of stabilizing the lid 4 and the fastening clamps 3 embodied thereon, provision is made for one or a plurality of reinforcement rib(s) 4', which extends across at least a part of the periphery of the lid 4. The fastening clamps 3 abut on the reinforcement rib 4' so that the elastic forces of the fastening clamps 3 can also be supported by the reinforcement rib 4' in a rearward manner, that is, towards the center of the lid.

Additionally, provision is made on the lid assembly 4 for at least one fastening arm 7, which extends across a predetermined length of the rear part of the lid assembly 1 in Y-direction. The fastening arm 7 is embodied in one piece with the lid 4 and is supported and guided on the rear side on the holding device 6, which is embodied as a rod. This ensures additional protection of the closing position of the lid assembly 1. At the same time, the occurring force can also be distributed to the fastening arm 7 and thus directly to the holding device 6 in response to stress peaks on the lid assembly 1.

Figure 2:
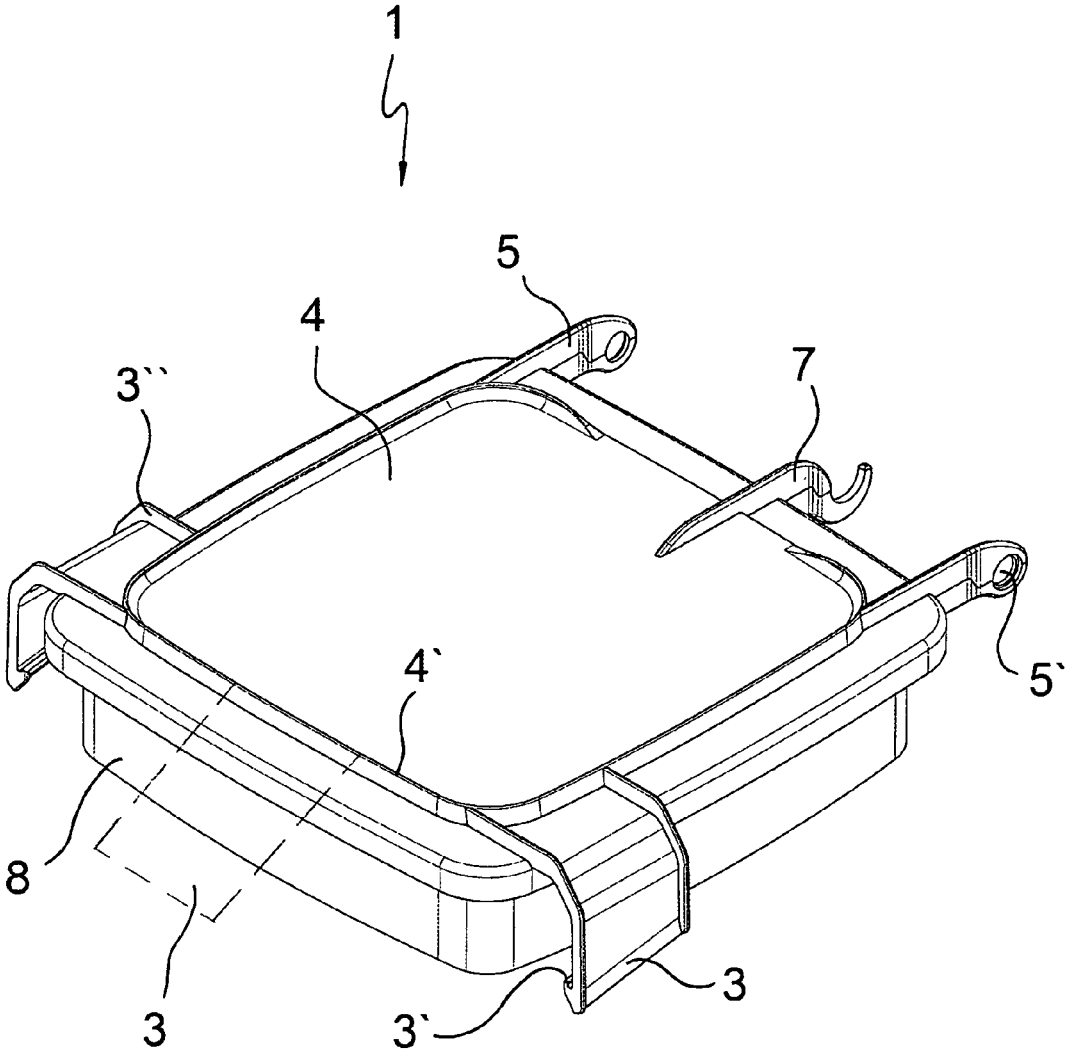
FIG. 2 shows the lid assembly of the invention in a perspective view at an incline from the top.

FIG. 2 shows the lid assembly 1 in a perspective view at an incline from the top. The lid 4 of the lid assembly 1 is closed. In the shown embodiment, provision is made in each case on the lid 4 in the front region on the left-hand side and on the right-hand side for a fastening clamp 3. Additionally, it would also be possible to provide an additional fastening clamp 3 (indicated by a dashed line) according to the lateral fastening clamps 3 in the front region, for example centrally. It is also possible to provide only one fastening clamp 3, which is arranged, for example, in the front region and which is dimensioned accordingly. The fastening clamps 3 have lateral reinforcements 3" on their lateral edge, by means of which the required stiffness and stability for securely holding the engagement position of the hook-shaped free ends 3' is ensured. On its rear end, the fastening arm 7 has the shape of a hook, which engages with the holding device 6 (see FIG. 1) and which is supported thereon. The shape, which fits the holding device 6, does not interfere with a rotary motion of the lid 4 about the holding device 6. In this embodiment, the lid assembly 1 furthermore encompasses a skirt 8, which is directed downwards and which can be inserted into the interior of a container 2. Preferably, the skirt 8 is embodied in one piece on the lid assembly 1 and is dimensioned in such a manner that it abuts in a correct fit on the inner wall of the container 2. High forces of the liquid in the container 2 acting on the lid assembly 1 (for example when the container 2 falls over) can thus also be distributed to the skirt 8 and an excess pressure on the lid seal can be reliably avoided. Preferably, the skirt 8 has a depth (in Z-direction) of from 10 to 150 mm, more preferably of from 70 to 100 mm.

Figure 3:
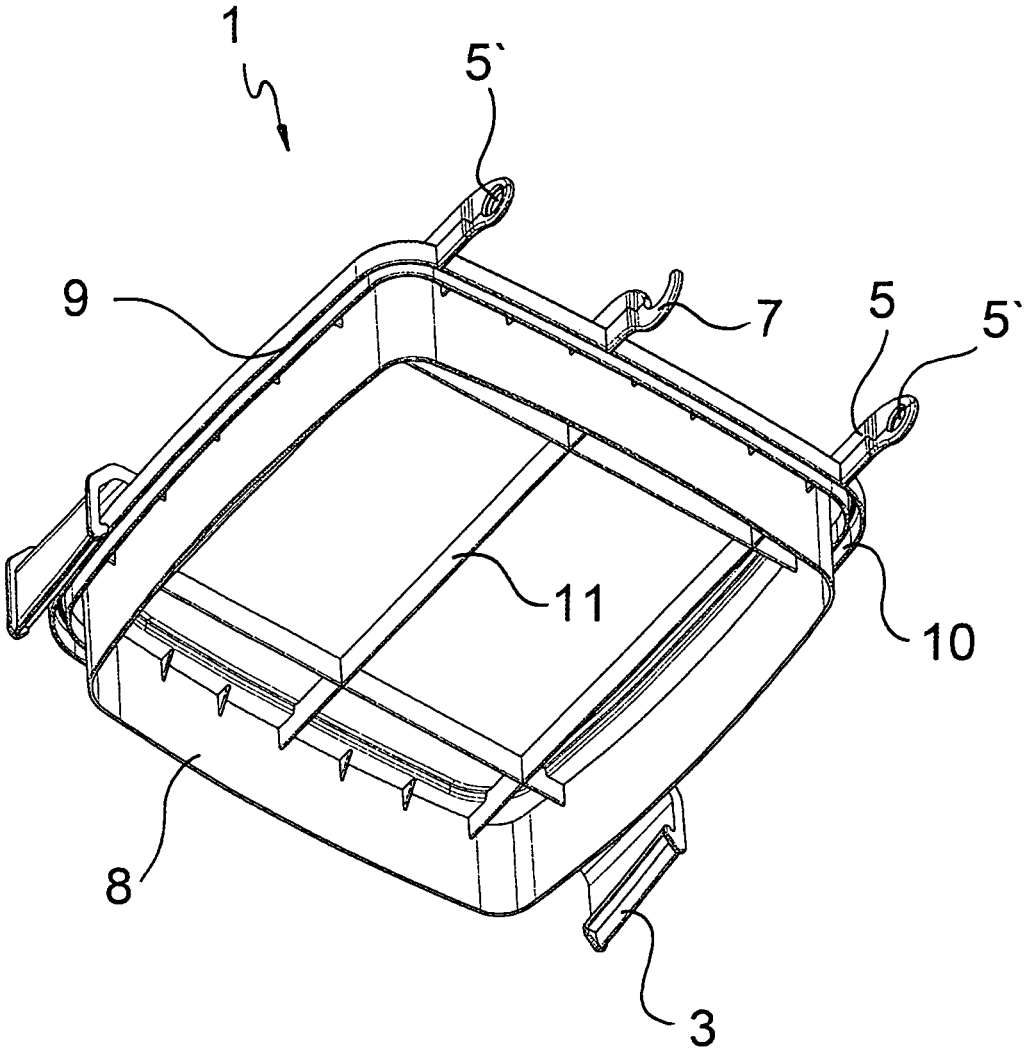
FIG. 3 shows the lid assembly of the invention in a perspective view at an incline from the bottom.

FIG. 3 shows the lid assembly 1 in a perspective illustration at an incline from the bottom. On its outer edge, the lid assembly 1 encompasses a groove 9, which is directed downwards, in which a seal 10, preferably a soft seal made of a suitable elastomer, runs. The groove 9 is embodied in such a manner that it can be attached to an edge, which extends upwards on the container 2 and so that a sealing of the lid assembly 1 with respect to the interior of the container 2 is thus ensured. In a special embodiment, the groove 9 is embossed in sections across its length, that is, at different depths, so that the seal 10 runs within the groove 9 at different depths. Provision can be made, for example, for the groove 9 to be embodied so as to have a lesser depth in the region of the fastening clamp 3 and on the rear side in the region of the fastening arm 7 so as to attain an increase of the compressive forces on the seal 10 into these regions. A particularly good impermeability of the lid assembly 1 can thus be attained. For stabilization and reinforcement purposes, respectively, the lid 4 encompasses reinforcement beams 11 on its lower side. The lid 4 thus does not deform in response to stresses and fits correctly on the edge provided on the container 2. In the illustrated embodiment, provision is made for a plurality of reinforcement beams 11 in a crosswise shape. However, any other pattern is also possible, provided that the lid 4 is sufficiently reinforced.

Figure 4:
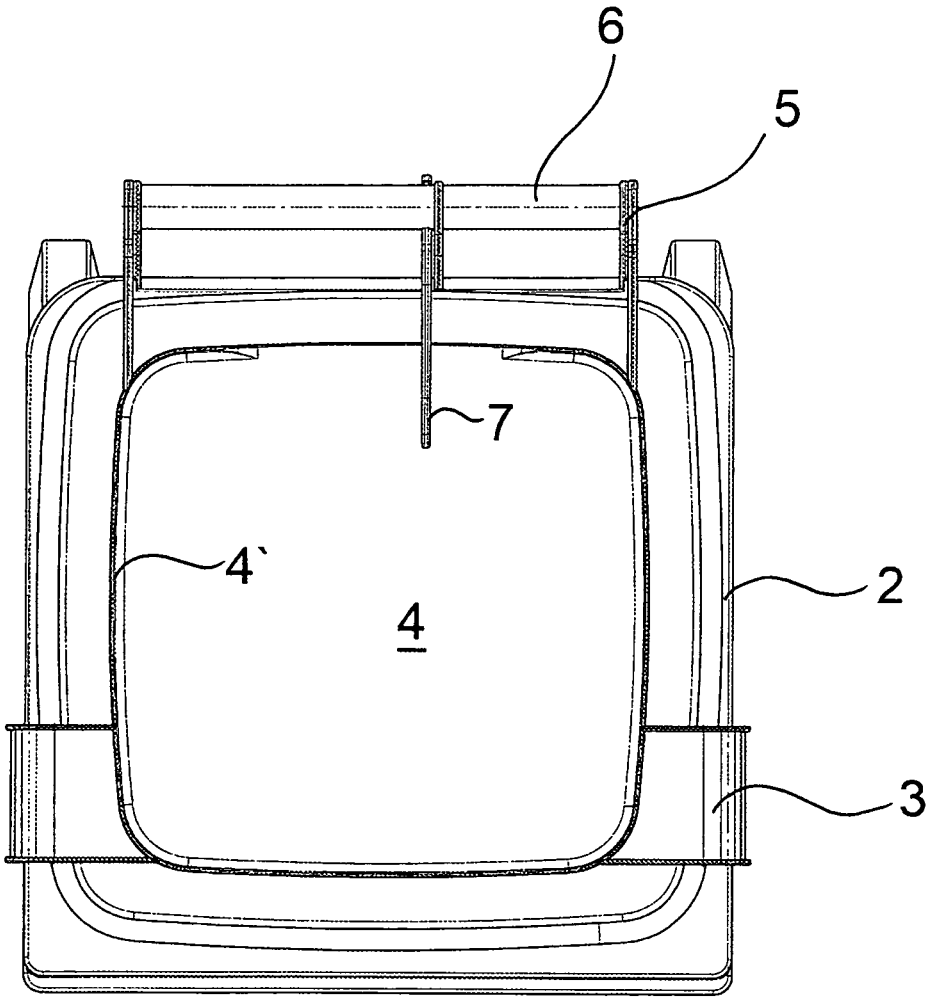
FIG. 4 shows the lid assembly of the invention on a container in a view from the top.

FIG. 4 illustrates the lid assembly 1 of the invention on a container 2 in a view from the top. It can be seen well here how the fastening clamps 3 overlap the outer edge of the container 2 and reach behind a flange of the container 2 with their hook-shaped free ends 3'.

Figure 5:
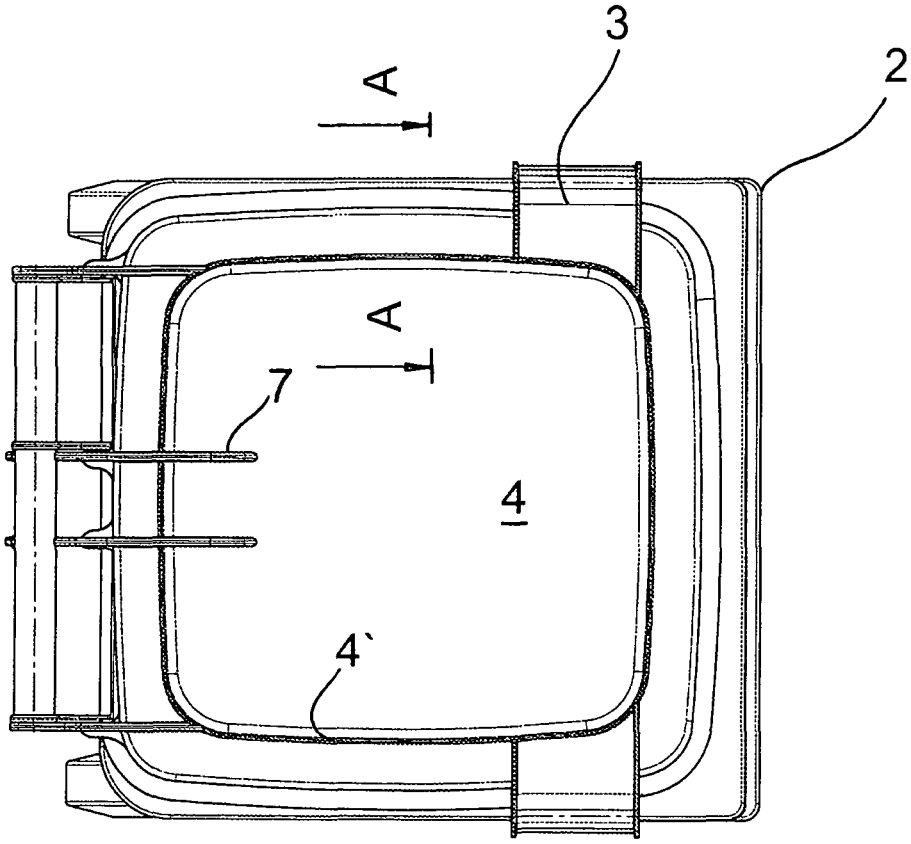
FIG. 5 shows a further embodiment of the lid assembly of the invention in a view from the top.

FIG. 5 illustrates the lid assembly 1 of the invention in a further embodiment in top view. The lid 4 hereby encompasses two fastening arms 7 arranged in the rear region, which guide the lid 4 on the holding device 6 in response to the opening and closing and which support the lid thereon in response to stresses. The reinforcement rib 4' runs across the entire periphery of the lid 4 and provides additional stabilization for the fastening arms 7.

Figure 6:
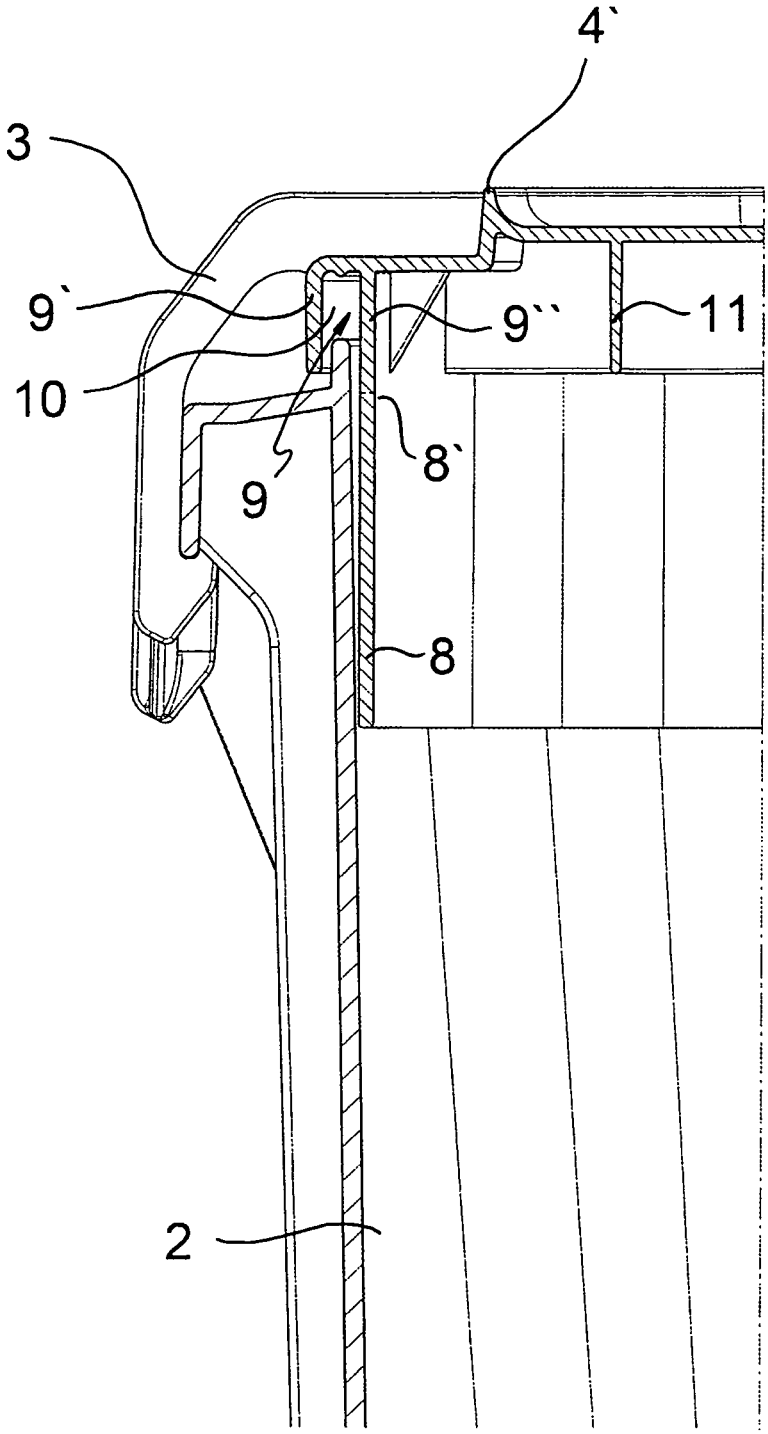
FIG. 6 shows a sectional view A-A from FIG. 5.

FIG. 6 is a sectional view along line A-A in FIG. 5. The lid 4 here comprises a groove 9, which is open in downwards direction, in which a seal 10 extends in peripheral direction. The groove 9 is formed by means of two webs 9', 9", which are directed downwards. The outer web 9' has a length, so that it reliably overlaps the edge of the container 2, which projects upwards, but so that it is spaced apart from the outer edge of the container 2, which faces upwards, in the closed state of the lid 4 as well. In the illustrated embodiment, the inner web 9" is extended and forms the skirt 8, which projects into the container 2. In so doing, a contamination of the edge region is reliably avoided. Preferably, the skirt 8 is embodied so as to be thin, that is, it has a thickness of approx. 2-10 mm. As illustrated in FIG. 6, clamp 3 engages a slanted flange of the container. The container flange having a first wall extending circumferentially from a container wall in a direction away from an opening defined by the container forming an acute angle with respect to the container wall and a second wall extending from the first wall in a direction away from the opening. The second wall extending in a plane generally parallel to the container wall.

Figure 7:
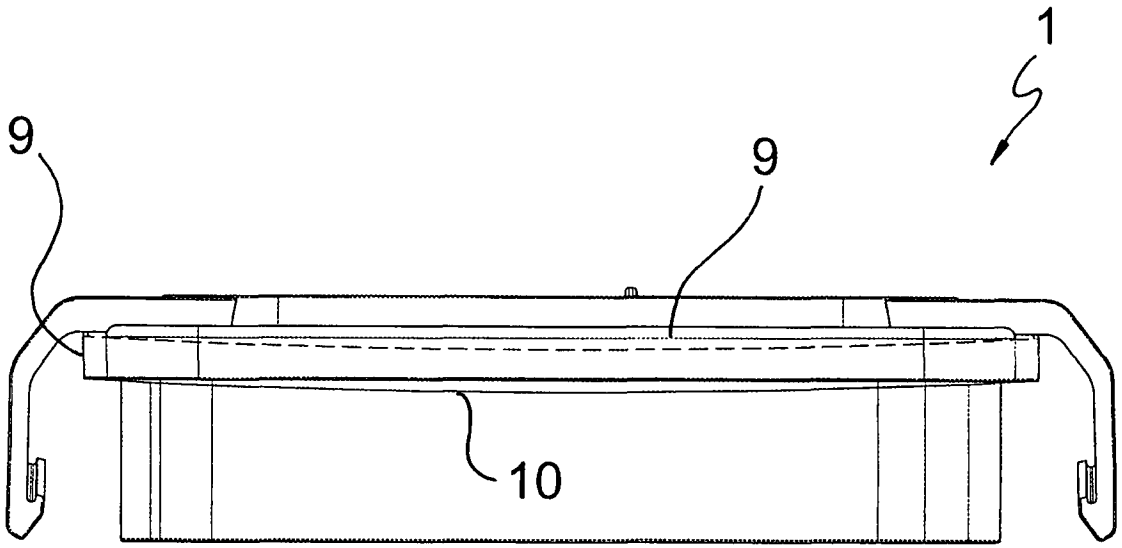
FIG. 7 shows a part of a lateral sectional view of the lid assembly.

FIG. 7 shows the lid assembly 1 in a side view. In this embodiment, the groove 9 extending in peripheral direction is embossed at the respective longitudinal sides. Preferably, the embossment has a height of from 2 to 4 mm. A particularly good seal is thus attained, because the seal 10 running in the groove 9 is fixedly pressed against the edge of the container 2, which projects upwards.

Figure 8:
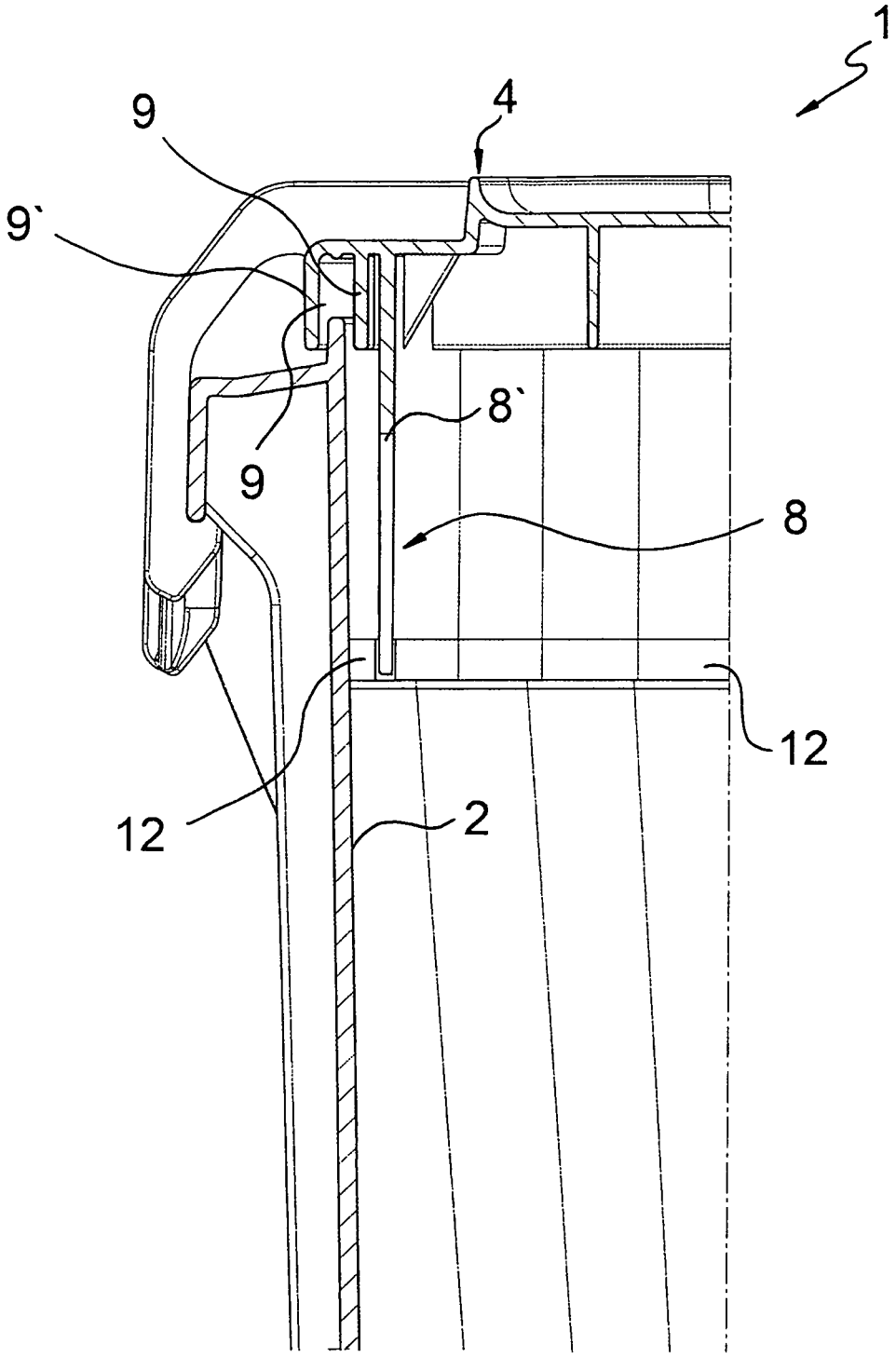
FIG. 8 shows a further embodiment of a part of the lid assembly in a sectional view and FIG. 9 shows a trash vessel or container comprising a spherical base with the lid assembly according to the invention.

FIG. 8 shows a sectional view of the lid assembly 1 according to a further embodiment. The features substantially correspond to those of FIG. 6, however the webs 9', 9" of the groove 9 have the same length. The skirt 8 is arranged as an additional element in the interior of the lid 4 and is spaced apart to the inner web 9". For sealing purposes, provision is made between the skirt 8 and the inner wall of the container 2 for a seal 12, preferably a rubber seal, which extends in peripheral direction. Such a seal can be attached to the edge of the skirt by means of an insertion groove and can press against the container wall by means of a sealing bead, which is integrally molded thereon laterally. The greater the distance between the skirt 8 and the groove 9, the longer the skirt 8 can be. It is not explicitly illustrated in FIG. 8, but provision can be made for the part of the skirt 8, which faces forwards and extends in Z-direction, to be shorter. This front skirt part can furthermore be provided so as to be elastically movable and so as to encompass a slit 8' at the corners. This skirt part can thus manually be pushed in Y-direction when the lid 4 is opened and, due to its elasticity, a reliable abutment on the front inner wall of the container 2 can thus be ensured in the closed state.

It is expressly pointed out that all of the different feature elements of the individual exemplary embodiments can be combined with one another arbitrarily, provided that this is technically possible and provided that there is no conflict. It is possible, e.g., to provide a skirt according to FIG. 6 abutting on the inner wall of the container with an additional seal 12 according to FIG. 8.

Figure 9:
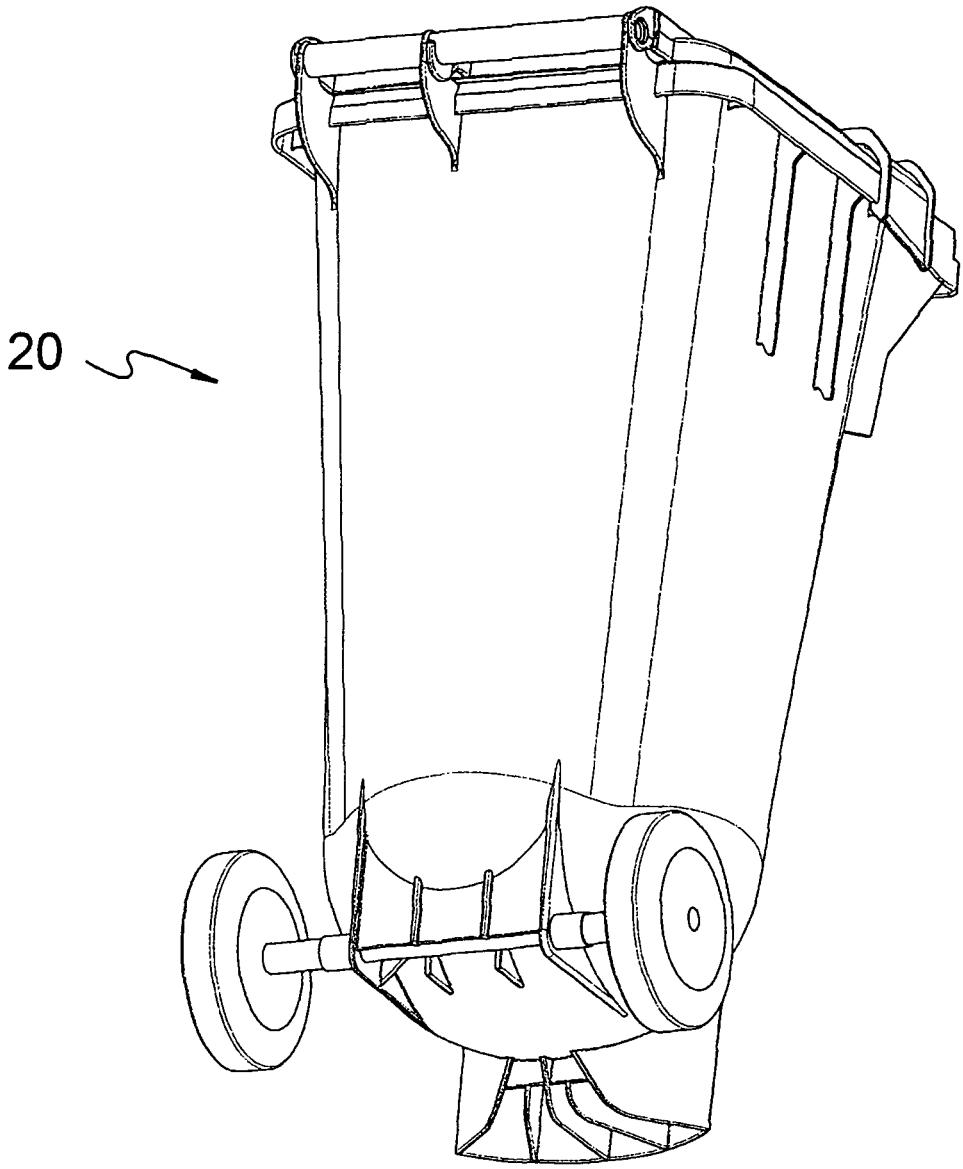

As can be seen from FIG. 9, the features as described in FIGS. 1 to 8 in combination with the exemplary embodiments of a lid are used for a lid for a container 20 comprising a spherical base in a particularly advantageous manner. A container 20 comprising a spherical base is superbly suitable for accommodating hot liquids, because the special structure, which is created due to the combination of a square container top comprising a spherical base, ensures a stability of the container even when it comprises hot content material. This stability is additionally increased by deforming the lid in the opening so that a bulging of wall regions in containers comprising a spherical base equipped with lids according to the invention does not occur.

What is claimed is:

1. A lid assembly in combination with a single piece container for liquids, the container comprising:

a container wall defining an opening;

a pair of downwardly projecting slanted flanges, the downwardly projecting slanted flanges including a first wall extending circumferentially from the container wall in a direction away from the opening defined by the container and a second wall extending from the first wall in the direction away from the opening defined by the container and in a plane generally parallel to the container wall, the second wall defining a slanted edge of the second wall, the slanted edge defining a first distance from the opening of the container wall at a first position and a second distance from the opening of the container wall at a second position, the second distance being greater than the first distance, the second position being spaced from the first position in the plane generally parallel to the container wall, the slanted edge extending continuously between the first and second position; and a pair of separate holding devices, each holding device extending circumferentially away from the container wall, the lid assembly comprising:

a lid;

two fastening clamps attached to the lid for fastening the lid assembly to the container, the two fastening clamps being arranged at lateral sides of the lid; and a pair of separate hinge arms attached to the lid which extend to a respective holding device arranged on the container; wherein the lid is pivotably held by the pair of separate holding devices on the container;

each of the fastening clamps is formed in one piece on the lid;

each of the fastening clamps extends from the lid in a direction of the container and includes a slanted hook-shaped free end, the slanted hook-shaped free end defining a surface corresponding to the slanted edge of the second wall of a respective slanted flange of the container;

the slanted hook-shaped free end of each of the fastening clamps extends behind the respective slanted flange on the container;

each of the slanted flanges is arranged adjacent a respective fastening clamp, and the slanted hook-shaped free end of each of the fastening clamps includes a chamfer which extends behind the respective slanted flange of the container.

2. The lid assembly according to claim 1, wherein each of the fastening clamps can be extended in an elastic manner.

3. The lid assembly according to claim 1, wherein each of the fastening clamps is made of plastic.

4. The lid assembly according to claim 1, wherein each of the fastening clamps includes lateral reinforcements.

5. The lid assembly according to claim 1, further comprising at least one fastening arm engaging the pair of holding devices, the at least one fastening arm extending across a predetermined length across the lid.

6. The lid assembly according to claim 5, wherein the at least one fastening arm is formed in one piece with the lid.

7. The lid assembly according to claim 1, further comprising a skirt extending downwards from the lid assembly, the skirt projecting into the container.

8. The lid assembly according to claim 7, wherein the skirt has a length of from 10 to 150 mm.

9. The lid assembly according to claim 7, wherein the skirt fits inside an inner wall of the container.

10. The lid assembly according to claim 7, further comprising a groove directed towards the container, the groove being complementary to an edge of the container which extends towards the lid assembly from the container.

11. The lid assembly according to claim 10, wherein the skirt is an extension of a web which forms one part of the groove.

12. The lid assembly according to claim 10, wherein portions of the groove have different depths.

13. The lid assembly according to claim 10, further comprising a seal arranged in the groove.

14. The lid assembly according to claim 1, wherein the lid includes reinforcement beams on a side adjacent the container.

15. The lid assembly according to claim 1, wherein the lid includes at least one reinforcement rib on a side opposite the container.

16. A use of a lid assembly according to claim 1, wherein:

the combination is used for a conventional, standardized trash can for a vessel or a container including a spherical base.

17. The lid assembly according to claim 1, further comprising a groove directed towards the container, the groove being complementary to an edge of the container which extends towards the lid assembly from the container.

18. The lid assembly according to claim 10, wherein the skirt is spaced inward from the groove.

19. The lid assembly according to claim 7, wherein the skirt is shorter along a front longitudinal side of the lid assembly.

20. The lid assembly according to claim 7, wherein the skirt is provided with slits on at least two corners of the container.

21. The lid assembly according to claim 1, wherein the first wall of the downwardly projecting slanted flanges forms an acute angle with respect to the container wall.

* * * * *

UNITED STATES PATENT AND TRADEMARK OFFICE

CERTIFICATE OF CORRECTION

PATENT NO. : 8,479,949 B2
APPLICATION NO. : 12/283065
DATED : July 9, 2013
INVENTOR(S) : Christoph Henkel It is certified that error appears in the above-identified patent and that said Letters Patent is hereby corrected as shown below:

In the Title Page:

(30) Foreign Application Priority Data:

"20 2007 012 923 U" should be -- 20 2007 012 923.8 --

In the Specification:

Before "Field Of The Invention" insert

-- CROSS REFERENCE TO RELATED APPLICATION

The present application is based on and claims priority from German Patent Application 20 2007 012 923.8, filed September 14, 2007, the contents of which are incorporated herein by reference. --

Signed and Sealed this
Twenty-ninth Day of October, 2013

Teresa Stanek Rea
*Deputy Director of the United States Patent and Trademark Office*